US009277783B2

(12) United States Patent
Amos et al.

(10) Patent No.: US 9,277,783 B2
(45) **Date of Patent: *Mar. 8, 2016**

(54) FOOTWEAR WITH POWER KICK PLATE

(71) Applicant: NIKE, Inc., Beaverton, OR (US)

(72) Inventors: Michael S. Amos, Beaverton, OR (US); Brian D. Baker, Portland, OR (US); Alexandre Baudouin, Portland, OR (US); Kevin P. Fallon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 30 days.

This patent is subject to a terminal disclaimer.

(21) Appl. No.: 14/284,078

(22) Filed: May 21, 2014

(65) Prior Publication Data

US 2014/0317963 A1 Oct. 30, 2014

Related U.S. Application Data

(63) Continuation of application No. 12/786,633, filed on May 25, 2010, now Pat. No. 8,782,928.

(51) Int. Cl.

| | |
|---|---|
| ***A43C 15/16*** | (2006.01) |
| ***A43B 13/18*** | (2006.01) |
| ***A43B 13/14*** | (2006.01) |

(Continued)

(52) U.S. Cl.

CPC . *A43B 13/18* (2013.01); *A43B 5/00* (2013.01); *A43B 5/02* (2013.01); *A43B 13/141* (2013.01); *A43B 13/223* (2013.01); *A43C 15/16* (2013.01)

(58) Field of Classification Search

CPC ..... A43B 13/00; A43B 13/141; A43B 5/00; A43C 15/00; A43C 15/02; A43C 15/16

USPC ..... 36/102, 59 R, 25 R, 128, 134, 114, 31

See application file for complete search history.

(56) References Cited

U.S. PATENT DOCUMENTS

| | | | |
|---|---|---|---|
| 2,258,734 | A | 10/1941 | Brady |
| 2,970,389 | A | 2/1961 | Milster |

(Continued)

FOREIGN PATENT DOCUMENTS

| | | | |
|---|---|---|---|
| CN | 2405448 | Y | 11/2000 |
| CN | 1829455 | A | 9/2006 |

(Continued)

OTHER PUBLICATIONS

International Search Report and Written Opinion dated May 20, 2011 for International Application No. PCT/US2011/029298, filed Mar. 22, 2011.

(Continued)

*Primary Examiner* — Marie Bays

(74) *Attorney, Agent, or Firm* — Plumsea Law Group, LLC

(57) ABSTRACT

An article of footwear that includes an upper that secures the article of footwear to a wearer. The footwear also includes a sole assembly that is operably coupled to the upper. The sole assembly includes an outsole having a plurality of cleats and a groove. The groove includes a first internal surface and a second internal surface. The first and second internal surfaces move away from each other as the sole assembly flexes in a first direction, and the first and second internal surfaces abut each other to limit movement of the sole assembly in a second direction opposite the first direction.

19 Claims, 4 Drawing Sheets

(51) Int. Cl.

| | |
|---|---|
| ***A43B 13/22*** | (2006.01) |
| ***A43B 5/00*** | (2006.01) |
| ***A43B 5/02*** | (2006.01) |

(56) References Cited

U.S. PATENT DOCUMENTS

| | | | | |
|---|---|---|---|---|
| 4,454,662 | A | 6/1984 | Stubblefield | |
| 4,569,142 | A | 2/1986 | Askinasi | |
| 4,742,626 | A | 5/1988 | Tadiotto | |
| 4,858,343 | A | 8/1989 | Flemming | |
| 5,197,210 | A | 3/1993 | Sink | |
| 5,661,915 | A | 9/1997 | Smith | |
| 5,836,094 | A | 11/1998 | Figel | |
| 6,079,126 | A | 6/2000 | Olszewski | |
| 6,115,945 | A | 9/2000 | Ellis, III | |
| 6,857,205 | B1 | 2/2005 | Fusco et al. | |
| 8,782,928 | B2 * | 7/2014 | Amos et al. | 36/102 |
| 2004/0045190 | A1 | 3/2004 | Washburn et al. | |
| 2004/0148804 | A1 | 8/2004 | Romano et al. | |
| 2005/0016029 | A1 | 1/2005 | Auger et al. | |
| 2005/0262739 | A1 | 12/2005 | McDonald et al. | |
| 2006/0059724 | A1 | 3/2006 | Garneau | |
| 2006/0064905 | A1 | 3/2006 | Hudson et al. | |
| 2010/0154258 | A1 | 6/2010 | Scholz et al. | |

FOREIGN PATENT DOCUMENTS

| | | | |
|---|---|---|---|
| CN | 1882260 | A | 12/2006 |
| EP | 0123550 | A1 | 10/1984 |
| EP | 0682886 | | 11/1995 |
| FR | 2527428 | A1 | 12/1983 |

OTHER PUBLICATIONS

International Preliminary Examination Report and Written Opinion, dated Dec. 6, 2012 for International Application No. PCT/US2011/029298, filed Mar. 22, 2011.

Chinese Office Action issued Jul. 1, 2014, for Chinese Patent Application No. 201180025811.1.

Advertisement: Powerspine.

Second Office Action mailed Feb. 28, 2015 for Chinese Patent Application No. 201180025811.1 filed Nov. 12, 2012.

Supplementary European Search Report for Application No. EP11787055, mailed on Mar. 24, 2015, 5 pages.

Text of the Third Office Action mailed Sep. 7, 2015 for Chinese Patent Application No. 2011800258111 filed Nov. 26, 2012.

* cited by examiner

FOOTWEAR WITH POWER KICK PLATE

CROSS-REFERENCE TO RELATED APPLICATION(S)

This application is a continuation of co-pending U.S. patent application Ser. No. 12/786,633 filed May 25, 2010, the disclosure of which is hereby incorporated by reference in its entirety.

FIELD

The present disclosure relates to footwear and, more particularly, relates to an article of footwear with a power kick plate.

BACKGROUND

Articles of footwear can include an upper and a sole assembly. The upper can include layers or sections of material that wrap about and cover a substantial portion of the wearer's foot and ankle. The upper can also include laces, straps, or the like for securing the footwear to the wearer's foot. The sole assembly can include an outsole and a midsole. The outsole can be a unitary piece of relatively high-friction material that provides traction. The midsole can include foam that is disposed between the outsole and the upper for providing cushioned support for the wearer.

Moreover, people that play soccer, rugby, American football, baseball, and the like often wear shoes with cleats. The cleats act as areas of high pressure on the sole of the footwear and can sometimes penetrate the playing surface for increased traction. The sole is typically made out of a stiff material to make the sole robust and durable. The sole may also include ribs and other features that increase the stiffness of the sole assembly.

However, some cleated footwear may be too stiff and may restrict natural flexing of the foot. For instance, when the wearer is running, the forefoot of the wearer can push off the ground while the rear of the foot is bent upwards away from the ground. If the sole is too stiff, motion of the rear of the foot off the ground may be inhibited. As such, the shoe may be uncomfortable, the wearer's performance may be reduced, etc.

On the other hand, some of these cleated sole assemblies may be too flexible and may not provide sufficient support of the foot during certain activities, such as kicking an object, slide tackling, dragging the forefoot of the shoe on the ground, etc. For instance, when kicking a ball, it is desirable for the striking foot to be substantially stiff to deliver a powerful kicking force to the ball. If the shoe of the striking foot is sufficiently stiff, the shoe can help deliver a greater kicking force to the ball. However, if the shoe is too flexible, the shoe may not sufficiently support the foot, and the kicking force may be reduced.

Accordingly, there remains a need for an article of footwear that provides a sufficient balance between stiffness and flexibility such that the footwear can be useful over a wider range of activities. Furthermore, there remains a need for an article of footwear that has cleats and that provides sufficient support, for instance, while kicking a ball or other object.

SUMMARY

Accordingly, despite the improvements of known devices described above, there remains a need for an article of footwear that includes an article of footwear is disclosed that includes an upper that secures the article of footwear to a wearer. The footwear also includes a sole assembly that is operably coupled to the upper. The sole assembly includes an outsole having a plurality of cleats and a groove. The groove includes a first internal surface and a second internal surface. The first and second internal surfaces move away from each other as the sole assembly flexes in a first direction, and the first and second internal surfaces abut each other to limit movement of the sole assembly in a second direction opposite the first direction.

Also, an article of footwear is disclosed that has a longitudinal axis and a transverse axis that is transverse to the longitudinal axis. The article of footwear includes an upper that secures the article of footwear to a wearer and a sole assembly that is operably coupled to the upper. The sole assembly includes an outsole having a plurality of cleats, a groove, and a rib. The groove extends through the rib, and the groove includes a first internal surface and a second internal surface. The first and second internal surfaces move away from each other as the sole assembly flexibly rotates in a first direction about the transverse axis. Also, the first and second internal surfaces abut each other to limit rotation of the sole assembly in a second direction opposite the first direction. The article of footwear defines a longitudinal axis, and the groove extends longitudinally in a direction transverse to the longitudinal axis of the article of footwear.

Moreover, a cleated shoe is disclosed that has a longitudinal axis and a transverse axis that is substantially perpendicular to the longitudinal axis. The cleated shoe includes an upper that secures the article of footwear to a wearer and a sole assembly that is operably coupled to the upper. The sole assembly includes a midsole and an outsole, and the sole assembly further includes a forefoot area that supports a forefoot of a wearer. The outsole has a plurality of cleats, a groove included on the forefoot area, and a rib with an axis that intersects the plurality of cleats. The groove extends only through the rib. Moreover, the sole assembly includes a base from which the plurality of cleats extend. The base includes a thick section and a thin section that is thinner than the thick section. The thick section and the thin section intersect at an edge, and the groove coincides with the edge. Furthermore, the groove extends substantially parallel to the transverse axis. The groove includes a first internal surface and a second internal surface that extend substantially normal to a lower surface of the outsole. The first and second internal surfaces rotate away from each other as the sole assembly flexibly rotates in a first direction about the transverse axis, and the first and second internal surfaces rotate toward each other and abut each other to limit rotation of the sole assembly in a second direction opposite the first direction.

Still further, an article of footwear is disclosed that includes an upper that secures the article of footwear to a wearer. The article of footwear also includes a sole structure that is operably coupled to the upper. The sole structure extends from the upper generally in a vertical direction. The sole structure includes an outsole having a base. The outsole further includes an elongate rib that projects from the base generally in the vertical direction. The base and the rib cooperate to define a ground engaging surface of the sole structure. The base extends relative to the upper generally in a horizontal direction. The base defines a first section, a second section, and a third section that separates the first and second sections generally in the horizontal direction. The sole structure has a thickness measured generally in the vertical direction, and the thickness at the third section is less than the thickness at the first and second sections to provide greater flexibility at the third section as compared to the first and second sections. A step of the sole structure is defined at a transition from the third section to one of the first and second sections. The elongate rib extends along the base generally in the horizontal direction across the first section, the second section, and the third section. The outsole further includes a groove extending into the elongate rib generally in the vertical direction. The groove is defined by a first internal surface and a second internal surface. The first and second internal surfaces are configured to move away from each other as the sole structure flexes in a first flex direction. The first and second internal surfaces abut each other to limit flexure of the sole structure flexes in a second flex direction. The first and second flex directions are opposite each other. The groove is substantially aligned with the step in the horizontal direction.

Additionally, an article of footwear is disclosed that includes an upper that secures the article of footwear to a wearer and a sole structure that is operably coupled to the upper. The sole structure includes an outsole having a base. The base extends relative to the upper in a horizontal direction. The outsole further includes an elongate rib that projects from the base. The base and the elongate rib cooperate to define a ground engaging surface of the sole structure. The base includes a first section, a second section, and a third section that separates the first and second sections generally in the horizontal direction. The sole structure has a thickness measured generally in a thickness direction. The thickness at the third section is less than the thickness at the first and second sections to provide greater flexibility at the third section as compared to the first and second sections. The elongate rib has a rib longitudinal axis. The elongate rib extends along the rib longitudinal axis to extend across the first section, the second section, and the third section of the base. The elongate rib further includes a first groove extending into the elongate rib generally in the thickness direction. The first groove is defined by a pair of first internal surfaces. The elongate rib further includes a second groove extending into the elongate rib generally in the thickness direction. The second groove is defined by a pair of second internal surfaces. Both the first groove and the second groove are proximate the third section of the base. The first groove and the second groove are spaced apart at a distance measured along the rib longitudinal axis. The sole structure is configured to flex in a first flex direction such that at least one of the first and second pairs of internal surfaces move away from each other. The sole structure is also configured to flex in a second flex direction such that at least one of the first and second pairs of internal surfaces abut each other to limit flexure of the sole structure in the second flex direction.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
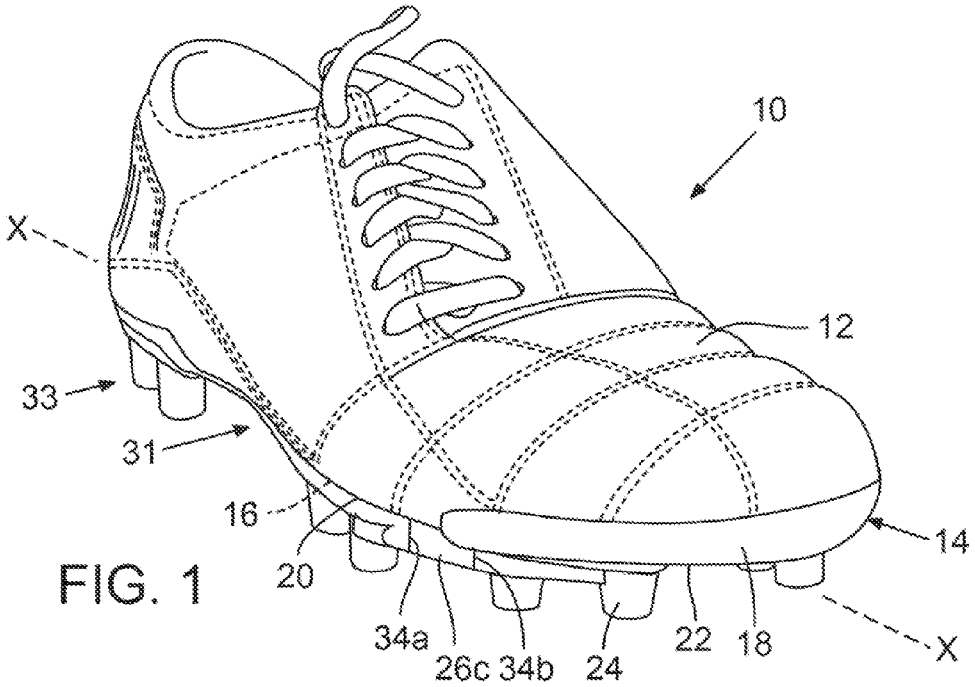
FIG. 1 is a perspective view of an article of footwear according to various exemplary embodiments of the present disclosure, the article footwear shown in an unflexed position.
Figure 2:
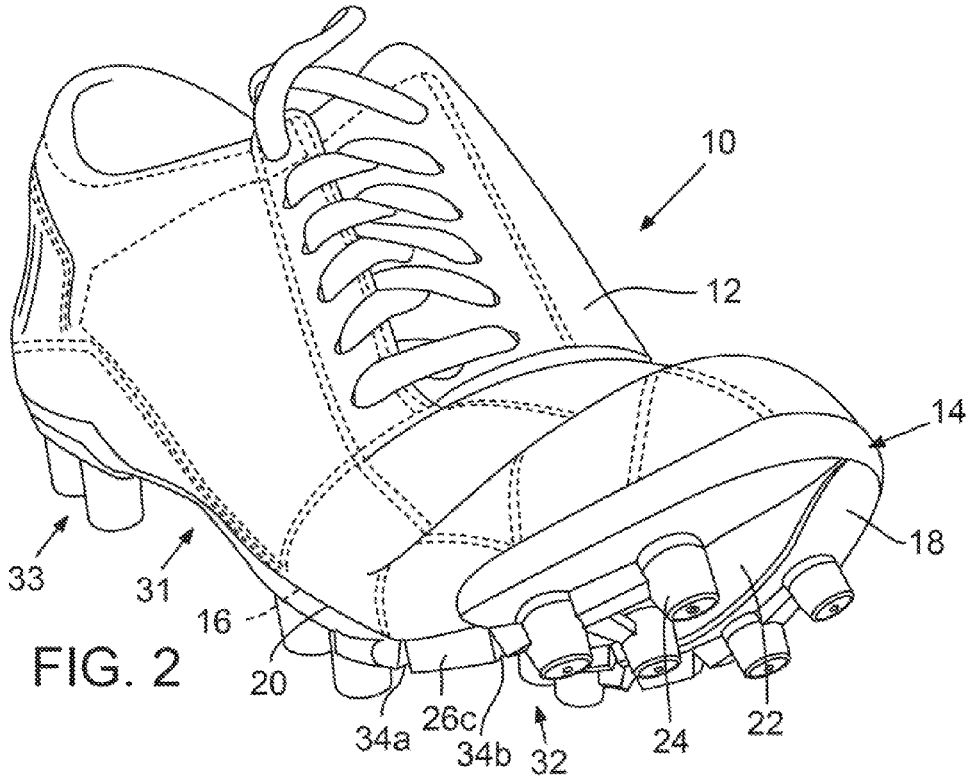
FIG. 2 is a perspective view of the article of footwear of FIG. 1 shown in a flexed position.
Figure 3:
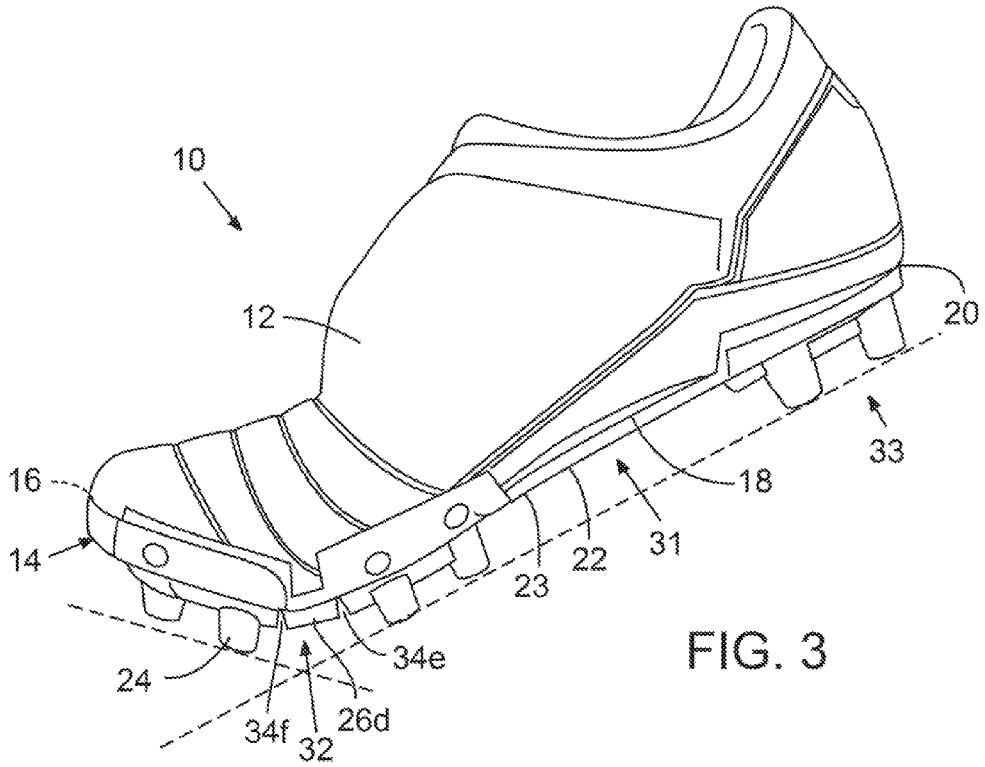
FIG. 3 is a side view of the article of footwear of FIG. 1 shown in the flexed position.
Figure 4:
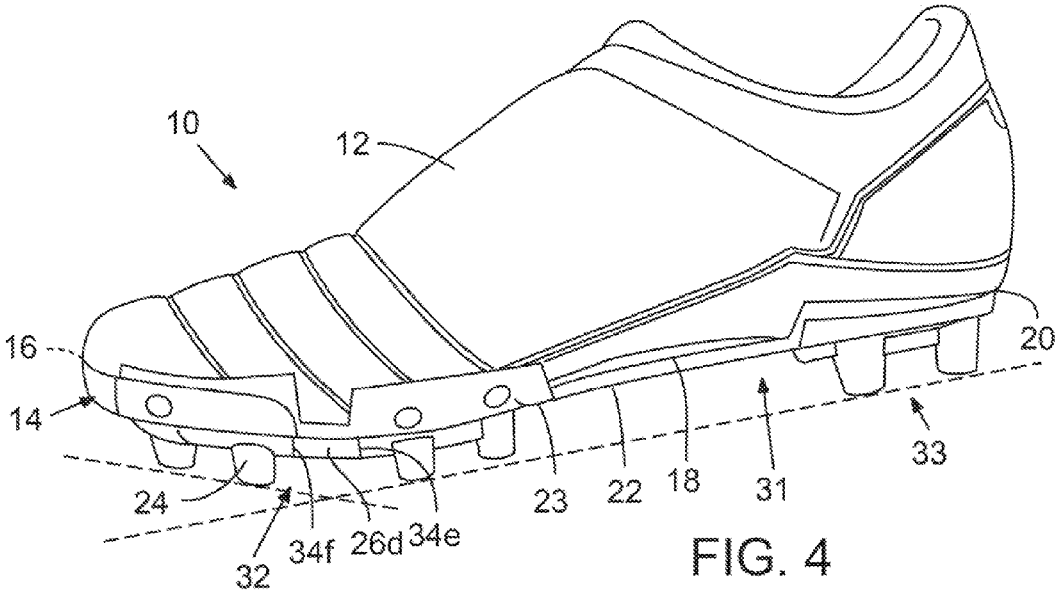
FIG. 4 is a side view of the article of footwear of FIG. 1 shown in the unflexed position.
Figure 5:
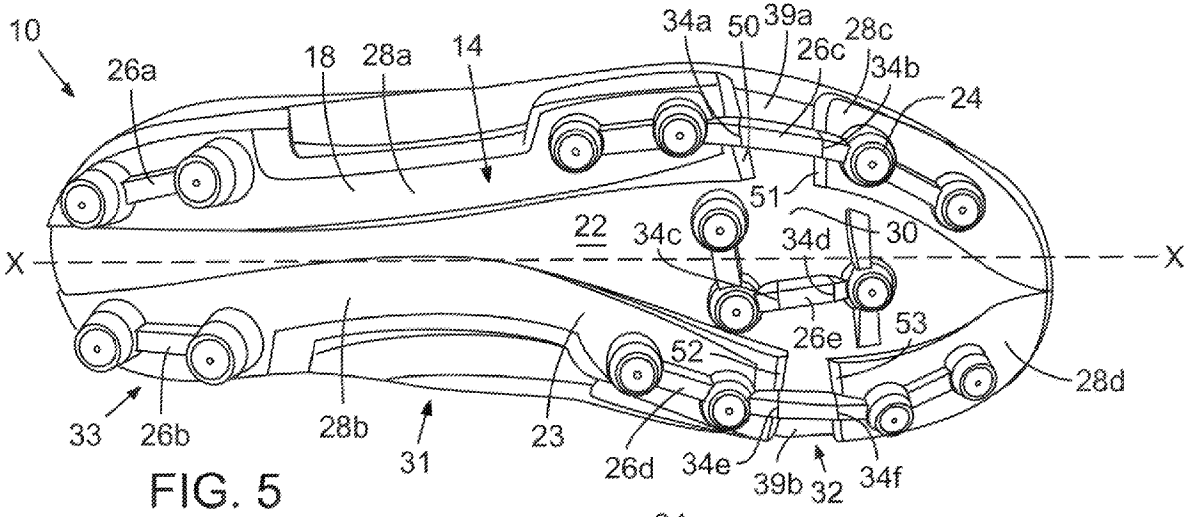
FIG. 5 is a bottom view of the article of footwear of FIG. 1 shown in the unflexed position.

Referring initially to FIGS. 1 and 2, an exemplary embodiment of an article of footwear 10 is illustrated according to various teachings of the present disclosure. Generally, the article of footwear 10 can have a longitudinal axis X (FIGS. 1 and 5).

The article of footwear 10 can include an upper 12 that wraps around a portion of the wearer's foot (not shown) and that secures the article of footwear 10 to the wearer. The upper 12 can include various layers of material that partially overlap each other and that are operably secured to each other, for example, by stitching, adhesives, and the like. The upper 12 can additionally include a fastening feature, such as laces, buckles, pile tape and/or other features for further securing the upper 12 to the wearer's foot. It will also be appreciated that the upper 12 can include various decorative features for aesthetically enhancing the footwear 10. Moreover, it will be appreciated that the upper 12 can substantially cover the entire foot, such as a traditional shoe or boot, or the upper 12 can partially cover the foot, such as a sandal, etc., without departing from the scope of the present disclosure.

The article of footwear 10 can further include a sole assembly 14. The sole assembly 14 can be operatively coupled to the upper 12. The sole assembly 14 can include a midsole 16 and an outsole 18. The midsole 16 can include foam or other cushioning material that is disposed between the outsole 18 and the upper 12. The midsole 16 can provide cushioned support of the sole of the wearer's foot.

The outsole 18 can include a layer of material made of relatively high-friction material and can include various grooves, recesses, projections, indentations, or other features for improving traction of the footwear 10. For instance, the outsole 18 can be made or include thermoplastic polyurethane (TPU), PEBAX®, composite carbon fibers, etc. The outsole 18 can be secured to the midsole 16 and/or the upper 12 in any suitable fashion, such as adhesives, stitching, and the like.

More specifically, the outsole 18 can include an upper surface 20 and a lower surface 22. The upper surface 20 can abut and can be fixed to the midsole 16. The lower surface 22 can be opposite the upper surface 20 and can contact the ground, turf, track, or other playing surface.

Also, as shown in FIG. 5, the outsole 18 can include a forefoot area 32, a rearfoot area 33, and a middle area 31. The forefoot area 32 can support the forefoot (i.e., toes and ball of foot) of the wearer, the rearfoot area 33 can support the rear of the wearer's foot (i.e., the heel of the foot), and the middle area 31 can support the middle of the wearer's foot (i.e., the arch of the foot)

As shown in FIG. 5, the lower surface 22 can be three-dimensional and contoured. Also, the lower surface 22 can be defined by a base 23, a plurality of cleats 24, and a plurality of ribs 26*a*-26*e*, each of which will be discussed in greater detail below. Because of these features of the lower surface 22, the footwear 10 can be useful for playing soccer, American football, rugby, baseball, and the like as will be discussed.

The base 23 can include one or more thick sections 28*a*-28*d* and a thin section 30. The thick sections 28*a*-28*d* can have a greater thickness than the thin sections 30. In the exemplary embodiments represented in FIG. 5, the outsole 18 can include two thick sections 28*a*, 28*b* that are disposed on the periphery of the outsole 18, that extend continuously along the longitudinal axis X from the rearfoot area 33 to the forefoot area 32, and that are spaced apart on opposite sides of the axis X. Furthermore, the outsole 18 can include two thick sections 28*c*, 28*d* that are disposed on the periphery of the outsole 18, that extend along the longitudinal axis X along the forefoot area 32 and that are joined together at the forward-most point of the outsole 18. The thin section 30 can be disposed between the thick sections 28*a*, 28*b*, 28*c*, 28*d*. Furthermore, the thick sections 28*a*, 28*c* can be spaced apart along the axis X so as to define a dugout area 39*a* that extends transverse (e.g., approximately perpendicular) to the axis X. Likewise, the thick sections 28*b*, 28*d* can be spaced apart along the axis X so as to define a dugout area 39*b* that extends transverse (e.g., approximately perpendicular) to the axis X. The dugout areas 39*a*, 39*b* can be disposed on opposite sides of the axis X.

It will be appreciated that the thick sections 28*a*-28*d* can make the outsole 18 more durable and robust. Also, it will be appreciated that the thin section 30 (including the dugout areas 39*a*, 39*b*) can reduce the weight of the footwear 10 and can increase the flexibility of the outsole 18. Moreover, the thin section 30 can be located on the outsole 18 to define predetermined bending axes for the outsole 18. For instance, the thin section 30 (including the dugout areas 39*a*, 39*b*) can correspond in location to the joints between the toes and the metatarsals of the wearer to facilitate bending of the toes while wearing the footwear 10.

Moreover, the cleats 24 can extend away from the base 23. The cleats 24 can have a tubular shape, and the cleats 24 can be tapered slightly along their respective axes. However, the cleats 24 can have any suitable shape, including a cube-like shape, a pyramid-like shape, a spike-like shape, etc. In some embodiments, the cleats 24 can be integrally connected to the base 23 of the outsole 18 such that the cleats 24 and that base 23 are monolithic. In other embodiments, the cleats 24 can be removably coupled to the base 23. The cleats 24 can penetrate the ground or other playing surface and/or act as high pressure areas of the outsole 18. Accordingly, the cleats 24 can increase traction for the footwear 10.

Also, the outsole 18 can include any suitable number of cleats 24, and the cleats 24 can be located in any suitable location on the outsole 18. For instance, as shown in FIG. 5, a plurality of cleats 24 can be disposed on the forefoot area 32 of the footwear 10 and a plurality of cleats 24 can be disposed on the rearfoot area 33. More specifically, some of the cleats 24 can extend from each of the thick sections 28*a*, 28*b*, 28*c*, 28*d*, and some of the cleats 24 can extend from the thin section 30 in the forefoot area 32.

In addition, the ribs 26*a*-26*e* can extend away from the base 23, and the longitudinal axis of each rib 26*a*-26*e* can extend between and intersect respective pairs of cleats 24. For instance, the rib 26 a can extend between the cleats 24 disposed on the rearfoot area 33 of the thick section 28*a*, and the rib 26*b* can extend between the cleats 24 disposed on the rearfoot area 33 of the thick section 28*b*. Moreover, the rib 26*e* can extend between the cleats 24 on the forefoot area 32 on the thin section 30. The rib 26*c* can extend between the cleats 24 on the forefoot area 32 across the thick sections 28*a*, 28*c* and the dugout area 39*a*. Likewise, the rib 26*d* can extend between the cleats 24 on the forefoot area 32 across the thick sections 28*b*, 28*d* and the dugout area 39*b*. It will be appreciated that the ribs 26*a*-26*e* can increase the stiffness of the outsole 18.

Figure 6:
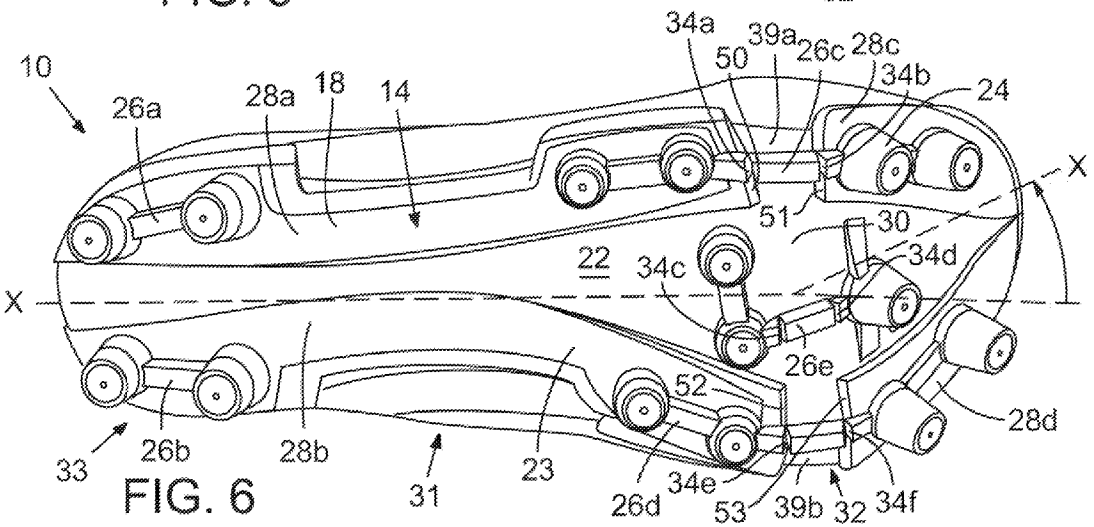
FIG. 6 is a bottom view of the article of footwear of FIG. 1 shown in the flexed position.
Figure 7:
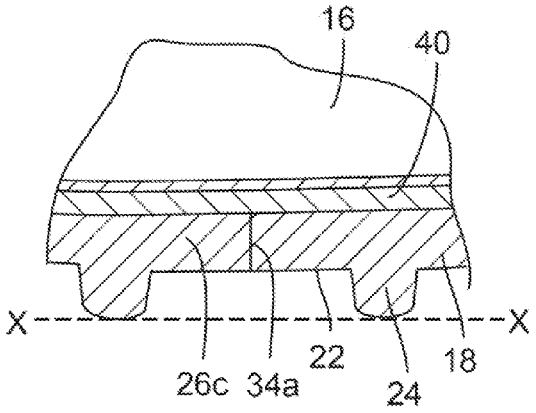
FIG. 7 is a detail side view of the article of footwear of FIG. 1 shown in the unflexed position.
Figure 8:
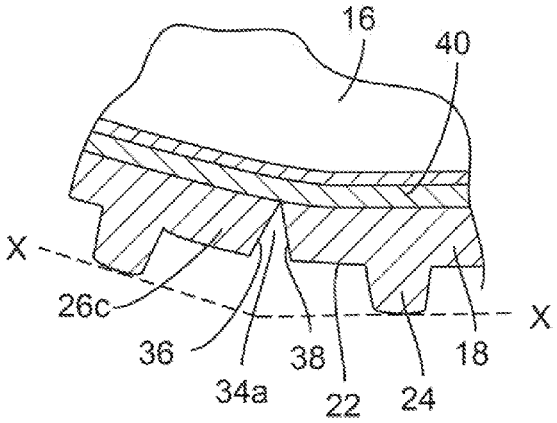
FIG. 8 is a detail side view of the article of footwear of FIG. 1 shown in the flexed position.

Additionally as shown in FIGS. 1-8, the footwear 10 can include one or more grooves 34*a*-34*f* (i.e., slits, etc.). The groove 34*a* is shown in detail in FIGS. 7 and 8, but it will be appreciated that the other grooves 34*b*-34*f* can be substantially similar. As shown in FIGS. 7 and 8, the grooves 34*a*-34*f* can include a first internal surface 36 and a second internal surface 38. The first and second internal surfaces 36, 38 can extend in a depth direction that is substantially normal to the lower surface 22 of the outsole 18. (In the case of a three-dimensionally contoured lower surface 22, the first and second internal surfaces 36, 38 can be substantially normal to a tangent of the lower surface 22.) In addition, as shown in FIG. 5, the grooves 34*a*-34*f* can extend longitudinally in a direction transverse (e.g., substantially perpendicular) to the longitudinal axis X of the footwear 10.

The grooves 34*a*-34*f* can be disposed at any suitable location on the footwear 10. For instance, the grooves 34*a*-34*f* can extend only through the ribs 26*c*, 26*d*, 26*e* (i.e., not through the base 23 or cleats 24 of the outsole 18). Also, in some embodiments, one or more of the grooves 34*a*-34*f* can extend through a cleat 24.

As shown in the illustrated embodiments of FIGS. 5 and 6, the groove 34*a* can extend through the rib 26*c* so as to coincide (i.e., substantially align) with a first step 50 defined at an intersection of the thick section 28*a* and the thin section 30. The groove 34*b* can extend through the rib 26*c* so as to coincide with a second step 51 defined at an intersection of the thick section 28*c* and the thin section 30. Moreover, the grooves 34*c*, 34*d* can extend through the rib 26*e* and can be spaced apart from each other along the axis X. Furthermore, the groove 34*e* can extend through the rib 26*d* so as to coincide with a third step 52 defined at an intersection of the thick section 28*b* and the thin section 30. Also, the groove 34*f* can extend through the rib 26*d* so as to coincide with a fourth step 53 defined at an intersection of the thick section 28*d* and the thin section 30.

Thus, the outsole 18 can flex between a first position (FIGS. 1, 4, 5, and 7) and a second position (FIGS. 2, 3, 6, and 8) about an axis that is transverse (e.g., perpendicular) to the longitudinal axis X. When moving from the first position to the second position, the first and second interior surfaces 36, 38 (FIG. 8) of the grooves 34*a*-34*f* can move away (i.e., rotate) away from each other about an axis that is transverse to the axis X. On the other hand, when moving from the second position to the first position, the first and second interior surfaces 36, 38 can move toward each other until the surfaces 36, 38 abut. The first and second interior surfaces 36, 38 can abut entirely such that the grooves 34*a*-34*f* closed completely in the second position. Abutment of the first and second interior surfaces 36, 38 can limit movement of the outsole 18 and stop flexure of the outsole 18 at the first position.

Thus, the grooves 34*a*-34*f* can increase flexibility of the outsole 18 to increase performance when the wearer runs and/or walks in the footwear 10. However, the abutment of the first and second interior surfaces 36, 38 can limit flexure of the outsole 18. This abutment can enhance performance during certain activities, such as kicking a ball, slide tackling, dragging the forefoot area 32 on the ground, etc. This is because the outsole 18 can be stiff enough to provide sufficient support to the foot during these activities. Moreover, the outsole 18 can protect the wearer. For instance, the outsole 18 can protect the wearer from overextending the foot and, for instance, straining the tendons on the top of the foot. Therefore, the footwear 10 can be substantially versatile for use in a variety of activities.

It will be appreciated that the grooves 34*a*-34*f* can have different depths, locations, etc. Also, in some embodiments, the grooves 34*a*-34*f* can be customized in depth, length, location, etc. depending on the intended activity of the wearer.

Also, the footwear 10 can include a covering member 40 as shown in FIGS. 7 and 8. The covering member 40 can be a relatively wide and flat layer of high-strength material that is disposed between the outsole 18 and the midsole 16. In some embodiments, the covering member 40 can be localized and cover only the grooves 34*a*-34*f*. In other embodiments, the covering member 40 can extend over and cover substantially the entire outsole 18. The covering member 40 can inhibit penetration of foreign objects into the midsole 16 through the grooves 34*a*-34*f*. For instance, if the wearer steps on a sharp object that enters one or move of the grooves 34*a*-34*f*, the covering member 40 can inhibit the object from penetrating into the midsole 16 or the wearer's foot. Furthermore, in some embodiments, the first and second internal surfaces 36, 38 of the grooves 34*a*-34*f* can be shaped such that foreign objects (e.g., dirt, small debris, etc.) within the grooves 34*a*-34*f* can be pushed out of the grooves 34*a*-34*f* as the first and second internal surfaces 36, 38 move toward each other. As such, the grooves—34*a*-34*f* can be self-cleaning. In still other embodiments, the grooves 34*a*-34*f* can be embedded and disposed entirely within the outsole 18 such that the grooves 34*a*-34*f* are unlikely to be exposed to such foreign objects.

Figure 9:
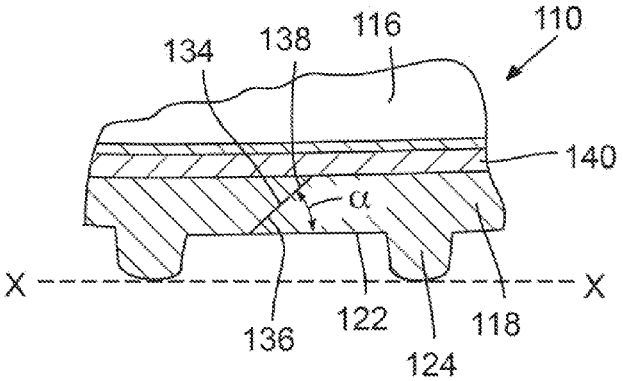
FIG. 9 is a detail side view of the article of footwear according to various other exemplary embodiments.

Referring now to FIG. 9, another exemplary embodiment of the footwear 110 is illustrated. Components that correspond to those of the embodiments of FIGS. 1-8 are indicated with corresponding reference numerals increased by 100.

As shown, the first and second internal surfaces 136, 138 of the groove 134 in the outsole 118 can extend in a depth direction that is at a positive, acute angle a relative to the lower surface 122 of the outsole 118. The angle of the groove 134 can allow the outsole 118 to flex in a predetermined fashion. Also, because of the angle of the groove 134, the first and second internal surfaces 136, 138 can have an increased amount of surface area against which to abut, and the outsole 118 can be stiffer as a result.

It will be appreciated that the groove 134 can extend at any suitable angle $\alpha$ without departing from the scope of the present disclosure. Moreover, in some embodiments, the angle $\alpha$ can be zero or one hundred eighty degrees. In other words, the groove 134 can be parallel to the lower surface 122 of the outsole 118. For instance, the outsole 118 can be moveable relative to the covering member 140 due to the groove 138 therebetween, and the groove 138 can be at least partially open to the outer periphery of the footwear 110. As such, the covering member 140, the midsole 116, etc. can flex upward away from the outsole 118 while the outsole 118 remains supported directly on the ground surface for added stability.

In summary, the footwear 10, 110 and, more specifically, the outsole 18, 118 can be flexible enough to enhance performance during certain activities (e.g., running, walking, etc.). Also, the outsole 18, 118 can be stiff enough to enhance performance during other activities (e.g., kicking an object, slide tackling, etc.). Thus, the outsole 18, 118 can provide an important balance between flexibility and stiffness, and the footwear 10, 110 can be versatile for use in a wider range of activities.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper that secures the article of footwear to a wearer; and a sole structure that is operably coupled to the upper, the sole structure extending from the upper generally in a vertical direction, the sole structure including an outsole having a base, the outsole further including an elongate rib that projects from the base generally in the vertical direction, the base and the rib cooperating to define a ground engaging surface of the sole structure;

the base extending relative to the upper generally in a horizontal direction;

the base defining a first section, a second section, and a third section that separates the first and second sections generally in the horizontal direction;

wherein the sole structure has a thickness measured generally in the vertical direction, wherein the thickness at the third section is less than the thickness at the first and second sections to provide greater flexibility at the third section as compared to the first and second sections;

wherein a step of the sole structure is defined at a transition from the third section to one of the first and second sections;

the elongate rib extending along the base generally in the horizontal direction across the first section, the second section, and the third section;

the outsole further including a groove extending into the elongate rib generally in the vertical direction, the groove defined by a first internal surface and a second internal surface;

wherein the first and second internal surfaces are configured to move away from each other as the sole structure flexes in a first flex direction, the first and second internal surfaces abutting each other to limit flexure of the sole structure flexes in a second flex direction, the first and second flex directions being opposite each other; and wherein the groove is substantially aligned with the step in the horizontal direction.

2. The article of footwear of claim 1, wherein the sole structure further includes a plurality of cleats.

3. The article of footwear of claim 2, wherein the elongate rib has a longitudinal axis that intersects the plurality of cleats.

4. The article of footwear of claim 1, wherein the groove extends into the elongate rib generally in the vertical direction and stops short of extending into the base.

5. The article of footwear of claim 1, wherein the groove extends into the elongate rib generally in the vertical direction substantially normal to the ground engaging surface.

6. The article of footwear of claim 1, wherein the groove extends into the elongate rib generally in the vertical direction at an acute angle relative to the ground engaging surface.

7. The article of footwear of claim 1, wherein the sole structure further includes a midsole and a covering member included between the outsole and the midsole, wherein the covering member overlaps the groove, the covering member configured to inhibit penetration of a foreign object into the midsole through the groove.

8. The article of footwear of claim 1, wherein the sole structure includes a forefoot area that is configured to support a forefoot of a wearer, and wherein the forefoot area includes the groove.

9. The article of footwear of claim 1, wherein the elongate rib projects from the base generally in the vertical direction and terminates at a lower surface, wherein the lower surface partially defines the ground engaging surface;

wherein the groove extends into the elongate rib via the lower surface; and wherein the groove separates a first area of the lower surface and a second area of the lower surface; and wherein the first area is substantially flush with the second area when the first and second internal surfaces abut.

10. The article of footwear of claim 1, wherein the step is a first step defined at a transition from the third section to the first section;

further comprising a second step defined at a transition from the third section to the second section;

wherein the groove is a first groove that is substantially aligned with the first step in the horizontal direction;

further comprising a second groove that extends into the elongate rib; and wherein the second groove is substantially aligned with the second step in the horizontal direction.

11. An article of footwear comprising:

an upper that secures the article of footwear to a wearer; and a sole structure that is operably coupled to the upper, the sole structure including an outsole having a base, the base extending relative to the upper in a horizontal direction, the outsole further including an elongate rib that projects from the base;

the base and the elongate rib cooperating to define a ground engaging surface of the sole structure;

the base including a first section, a second section, and a third section that separates the first and second sections generally in the horizontal direction;

wherein the sole structure has a thickness measured generally in a thickness direction, wherein the thickness at the third section is less than the thickness at the first and second sections to provide greater flexibility at the third section as compared to the first and second sections;

the elongate rib having a rib longitudinal axis, the elongate rib extending along the rib longitudinal axis to extend across the first section, the second section, and the third section of the base;

the elongate rib further including a first groove extending into the elongate rib generally in the thickness direction, the first groove defined by a pair of first internal surfaces;

the elongate rib further including a second groove extending into the elongate rib generally in the thickness direction, the second groove defined by a pair of second internal surfaces;

wherein both the first groove and the second groove are proximate the third section of the base;

wherein the first groove and the second groove are spaced apart at a distance measured along the rib longitudinal axis;

wherein the sole structure is configured to flex in a first flex direction such that at least one of the first and second pairs of internal surfaces move away from each other; and wherein the sole structure is configured to flex in a second flex direction such that at least one of the first and second pairs of internal surfaces abut each other to limit flexure of the sole structure in the second flex direction.

12. The article of footwear of claim 11, wherein the sole structure further includes a plurality of cleats.

13. The article of footwear of claim 12, wherein the longitudinal axis intersects a pair of the plurality of cleats.

14. The article of footwear of claim 11, wherein the first and second grooves extend into the elongate rib in the thickness direction and stop short of extending into the base.

15. The article of footwear of claim 11, wherein the first and second grooves extend into the elongate rib in the thickness direction substantially normal to the ground engaging surface.

16. The article of footwear of claim 11, wherein the first and second grooves extend into the elongate rib in the thickness direction at an acute angle relative to the ground engaging surface.

17. The article of footwear of claim 11, wherein the sole structure further includes a midsole and a covering member included between the outsole and the midsole;

wherein the covering member overlaps at least one of the first and second grooves; and wherein the covering member is configured to inhibit penetration of a foreign object into the midsole through the at least one of the first and second grooves.

18. The article of footwear of claim 11, wherein the sole structure includes a forefoot area that is configured to support a forefoot of a wearer, and wherein the forefoot area includes the first and second grooves.

19. The article of footwear of claim 11, wherein the elongate rib projects from the base generally in the thickness direction and terminates at a lower surface, wherein the lower surface partially defines the ground engaging surface;

wherein the first groove extends into the elongate rib via the lower surface; and wherein the first groove separates a first area of the lower surface and a second area of the lower surface; and wherein the first area is substantially flush with the second area when the first pair of internal surfaces abut.

* * * * *